United States Patent [19]

Diffrient

[11] Patent Number: 4,595,970

[45] Date of Patent: Jun. 17, 1986

[54] LAMP

[75] Inventor: Niels Diffrient, Ridgefield, Conn.

[73] Assignee: Hauserman, Inc., Cleveland, Ohio

[21] Appl. No.: 618,744

[22] Filed: Jun. 8, 1984

[51] Int. Cl.[4] ..... F21V 21/18

[52] U.S. Cl. ..... 362/287; 362/418; 362/427; 362/430

[58] Field of Search ..... 362/285, 287, 33, 97, 362/98, 370, 371, 417, 418, 427, 428, 429, 430

[56] References Cited

U.S. PATENT DOCUMENTS

| | | | |
|---|---|---|---|
| 2,608,367 | 8/1952 | Boltuch | 362/427 |
| 2,910,310 | 10/1959 | Mulac | 362/427 |
| 3,188,460 | 6/1965 | Thorsen et al. | 362/418 |
| 4,165,530 | 8/1979 | Sowden | 362/418 |
| 4,232,357 | 11/1980 | Dietz | 362/430 |
| 4,455,594 | 6/1984 | Yang | 362/427 |
| 4,494,177 | 1/1985 | Matthews | 362/287 |

FOREIGN PATENT DOCUMENTS

| | | | |
|---|---|---|---|
| 0336439 | 5/1921 | Fed. Rep. of Germany | 362/418 |
| 0078935 | 2/1919 | Switzerland | 362/97 |

*Primary Examiner*—Parshotam S. Lall

*Attorney, Agent, or Firm*—Renner, Otto, Boisselle & Lyon

[57] ABSTRACT

A lamp for use with a recline chair, or like item of furniture includes a pedestal, a horizontally extending light fixture and a three-link parallelogram linkage supporting said fixture from said pedestal. The pedestal and fixture include parallel surfaces extending approximately 45° to the horizontal in which the links are mounted with ball and socket joints. Two of the links extend beyond the ball joints and are interconnected by short transverse links. In the pedestal the connecting transverse link is connected to one or two tension coil springs balancing the light fixture in any position. The pedestal may support a cantilever table to serve as a side table for the furniture used with the lamp. The fixture may include a semi-cylindrical reflector with pivotal shades at each edge. The fixture is thus mounted and maintained in its horizontal position for adjustment throughout a spherical segment with the linkage moving within a right spherical cone, or from a horizontal to a vertical position, the axis of such cone thus extending at an angle of approximately 135° to the vertical axis of the pedestal.

29 Claims, 6 Drawing Figures

LAMPDISCLOSURE

This invention relates generally as indicated to a lamp and more particularly to a lamp for use with specialized furniture such as recline chairs enabling visual tasks to be performed while in such chairs and like furniture.

BACKGROUND OF THE INVENTION

Specialized furniture such as the recline chair shown in applicant's copending application Ser. No. 618,738, filed even date herewith, entitled "Recline Chair" requires specialized lighting if reading or other visual tasks are to be accomplished while in the chair. Such chairs may be used in offices or homes and are designed for reading or writing in a more comfortable position than the usual desk and chair.

Because the user of such furniture may be in several positions from full recline to sitting up, the lighting fixture of a lamp for such furniture should be widely adjustable over the top of the chair both vertically and horizontally. It should also be readily removable from above the chair so that the user may get into and out of the chair. A lamp for use with such furniture should also be useful with a wide variety of seating, lounges or even beds, where reading or writing may be done. It should also be useful in both home and office.

SUMMARY OF THE INVENTION

A lamp is provided for use with certain types of furniture such as recline chairs and includes a vertical pedestal. The top surface of the pedestal is inclined at about 45° from the horizontal and includes spherical or ball and socket mounting joints for three parallel tubular links forming a three link parallelogram linkage supporting the light fixture on the distal ends thereof. The light fixture includes a similar 45° mounting surface for ball and socket joints for the tubular links. Two of the links extend beyond the ball joints at each end and are interconnected by short transverse links. In the pedestal the connecting transverse link is connected to a tension coil spring balancing the light fixture in any position. In this manner the fixture is mounted and maintained in its horizontal position for adjustment in a spherical segment or both arcuately vertically and arcuately side-to-side. The linkage moves through or within a right spherical cone, or from a horizontal to a vertical position, the axis of such cone thus extending at an angle of approximately 135° to the vertical axis of the pedestal.

The pedestal may support a cantilever table to serve as a side table for the furniture used with the lamp. The table is in the form of a rotating tray on the end of a swing arm. The fixture may also include a semi-cylindrical reflector with pivotal shades at each edge.

The lamp portion may also be mounted elsewhere as on the cantilevered table pedestal shown and described in applicant's copending application Ser. No. 618,519 entitled "Table" filed even date herewith.

To the accomplishment of the foregoing and related ends the invention, then, comprises the features hereinafter fully described and particularly pointed out in the claims, the following description and the annexed drawings setting forth in detail certain illustrative embodiments of the invention, these being indicative, however, of but a few of the various ways in which the principles of the invention may be employed.

DETAILED DESCRIPTION OF THE PREFERRED EMBODIMENTS

Figure 1:
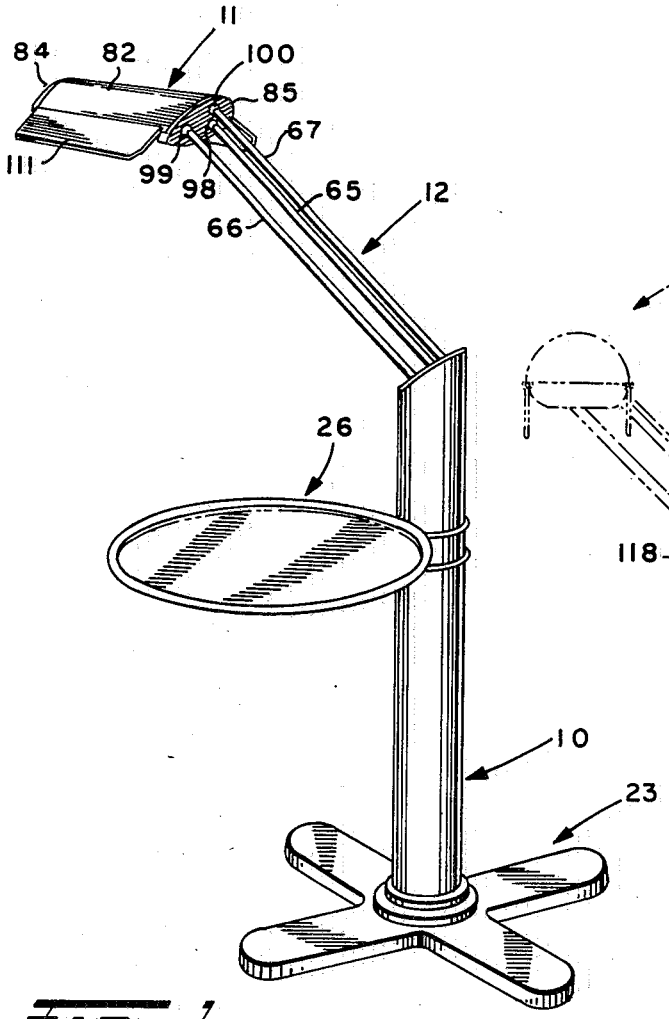
FIG. 1 is a perspective view of a lamp in accordance with the present invention.
Figure 2:
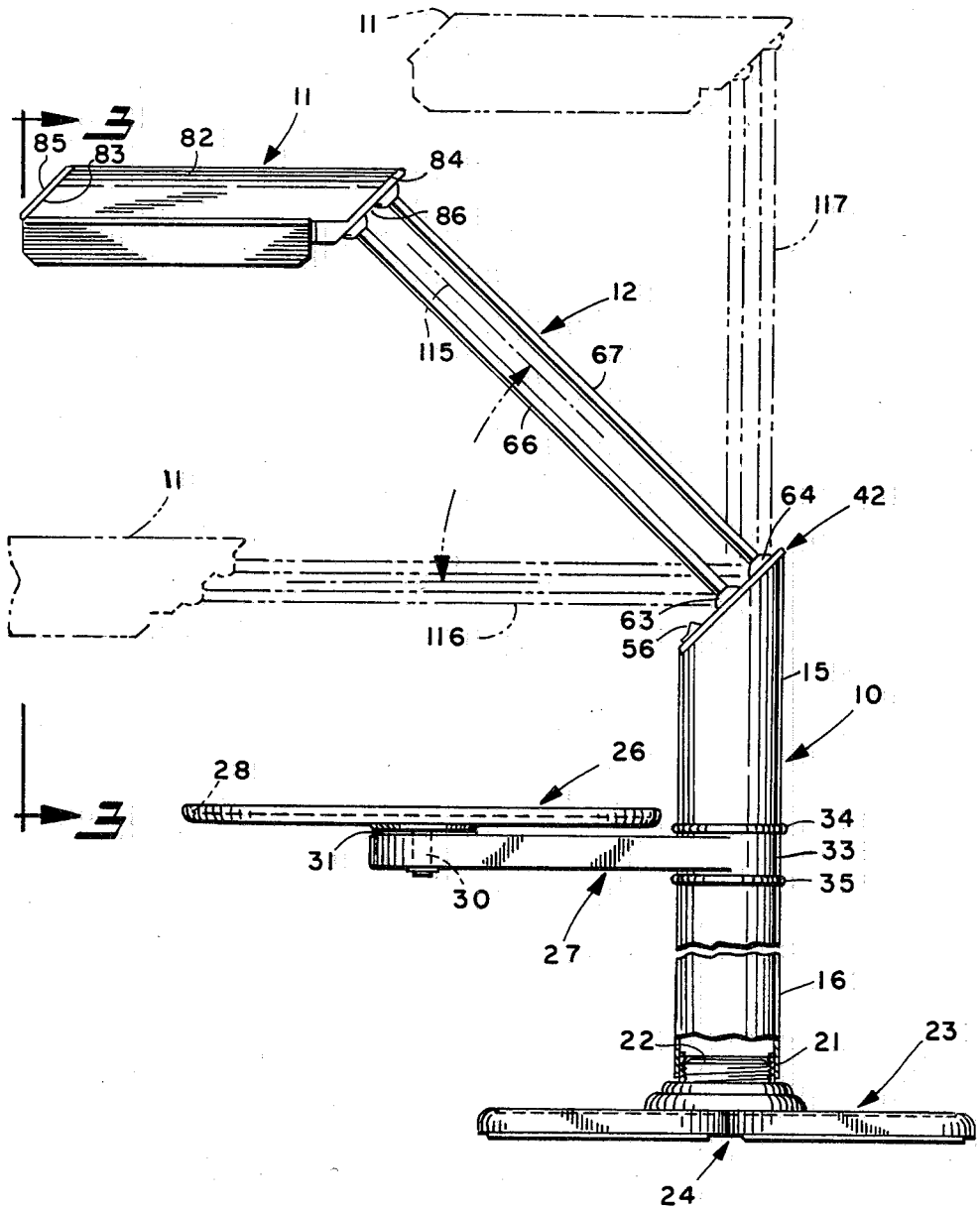
FIG. 2 is a somewhat enlarged side elevation of the lamp of FIG. 1 with the pedestal broken away.

Referring first to FIGS. 1 and 2 it will be seen that the lamp of the present invention includes a vertically extending cylindrical pedestal 10, a light fixture 11, and a three-link dual direction parallelogram linkage indicated generally at 12 supporting the fixture from the top of the pedestal.

Figure 4:
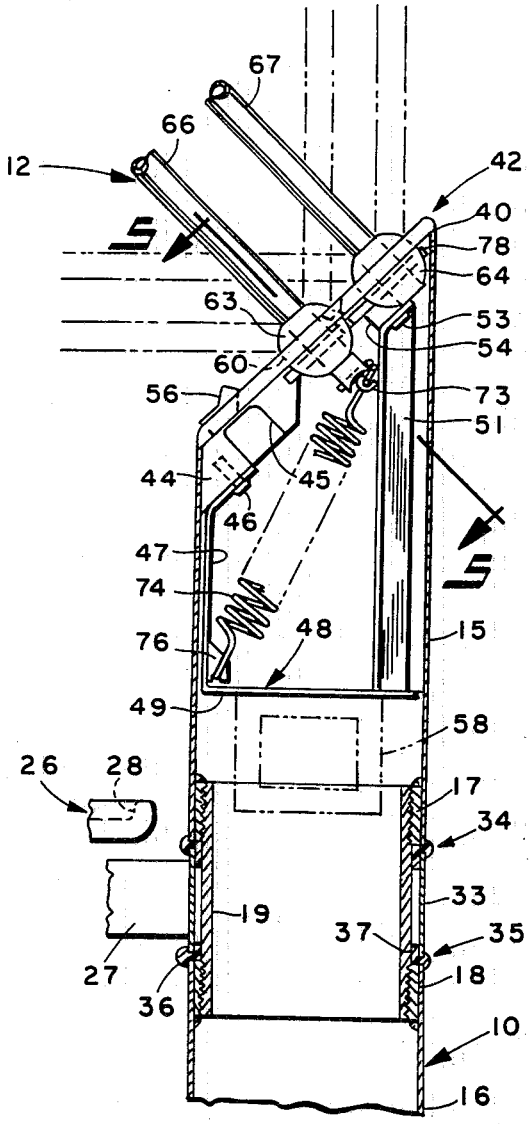
FIG. 4 is an enlarged fragmentary vertical section through the top of the pedestal.

Referring now additionally to FIG. 4, it will be seen that the pedestal comprises upper and lower tubular cylindrical elements 15 and 16 which have welded to the facing ends thereof internally threaded interior rings 17 and 18, respectively which are interconnected by externally threaded tubular connector 19. The lower end of the tubular element 16 also includes a threaded interior ring seen at 21 in FIG. 2 which is threadedly connected to relatively short threaded stanchion 22 projecting upwardly from the center of four-legged base 23. The interior of the threaded stanchion is hollow and the underside of the legs may be provided with recesses 24 on four sides accomodating electrical wiring.

The base 23 may be relatively heavy in order to provide stability for both the light fixture 11 extending laterally from the top of the pedestal as well as the table 26 shown in FIGS. 1 and 2 which is cantilevered from the pedestal on swinging arm 27.

The table 26 is in the form of a circular rotating tray which includes an upturned annular lip 28. The underside of the tray of the table includes a downwardly extending pivot pintle 30 which may be mounted in the distal end of swing arm 27. A plastic thrust bearing may be provided between the tray and arm as indicated at 31. The proximal end of the swing arm 27 includes a cylindrical hub 33 which is journaled between the ends of the tubular sections 15 and 16 of the pedestal on plastic trim bearings 34 and 35.

As seen more clearly in FIG. 4, such bearings are annular L-shape and include annular outwardly projecting beads 36 and axially extending flanges 37 which form sleeve bearings between the hub 33 and the threaded connector 19. In this manner the arm 27 may readily swing about the vertical axis of the pedestal 10 and the tray top of the table may rotate about the pintle 30.

Referring now more particularly to FIG. 4, it will be seen that the top section 15 of the pedestal 10 has an upwardly opening end edge 40, the plane of which extends at an angle of approximately 45° to the vertical axis of the pedestal. The upper edge of the section 15 then provies an eliptical opening extending at such 45° angle to the vertical and horizontal. Such opening is closed by a plastic mounting plate indicated generally at 42 which overlies the upper edges of the pedestal section 15. At the lower interior side thereof, the plastic mounting plate includes a boss 44 which in turn includes a recess 45. The boss is in the form of a parallelepiped prism and projects downwardly into the tubular section 15 closely adjacent the interior wall thereof.

Secured to the underside of the boss by fastener 46 is the upwardly inwardly bent portion of leg 47 of a metal frame shown generally at 48.

In addition to the leg 47, the frame 48 includes a bottom ring 49 fitting closely within the tubular section 15. The frame also includes upwardly extending legs 51 and 52 secured by fasteners 53 to bosses 54 projecting from the closure plate 42. In this manner the closure plate and the metal frame are secured together as a unit with the metal frame projecting downwardly into the top of the upper section 15.

As indicated in FIG. 4 the recess 45 in the boss 44 of the closure plate 42 may be provided with the contact mechanism for a rocker switch 56. A transformer indicated in dotted lines at 58 may be mounted on the underside of the ring 48 of the frame.

The cover plate 42 includes three spherical wall apertures 60 arranged in the fashion of an equilateral triangle with the larger diameter of such apertures being on the underside of the cover. Such spherical apertures accomodate spheres or balls 62, 63 and 64 mounted on parallel tubular links 65, 66 and 67, respectively.

The links 65, 66 and 67 may be formed of thin wall tubing and wiring from the pedestal to the fixture may extend through the links 65 and 66 while the link 67 is normally empty.

Figure 5:
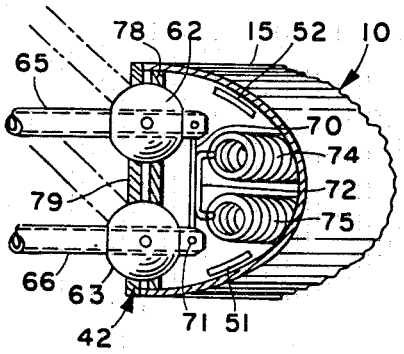
FIG. 5 is a fragmentary section also through the top of the pedestal as seen from approximately the line 5—5 of FIG. 4; and, FIG. 6 is a fragementary broken away illustration partially in section of the connection between the parallelogram linkage and the light fixture.

As seen more clearly in FIGS. 4 and 5, the links 65 and 66 extend slightly inwardly of the balls or spheres 62 and 63 and are interconnected by a pin link shown generally at 70 which includes downturned ends 71 extending diametrically through the tubing links 65 and 66. The transverse link 70 includes a U-shape member 72, the downturned legs of which are formed into spring hooks 73. Such hooks form upper anchors for a pair of tension springs 74 and 75 which are in turn anchored at their lower ends to hooks 76 mounted on the lower portion of the the frame 48. It will be appreciated that one or more than a pair of springs may be employed.

In order to maintain the balls or spheres 62, 63 and 64 in the respective spherical apertures in the plastic cover plate 42, there is provided a pressure plate 78 which is adjustably secured to the cover plate by fastener 79 in the center of the triangular arrangement of links. The pressure plate includes spherical wall apertures with the larger diameter thereof opening toward the cover plate and with the center of the spheres spaced between the slightly spaced surfaces of the pressure plate and cover plate, respectively.

Figure 6:
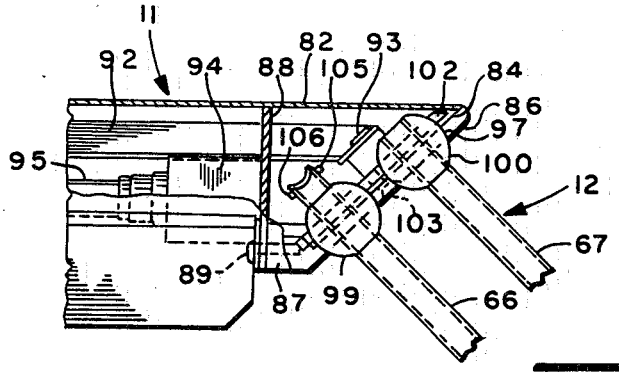

Referring now primarily to FIGS. 2 and 6, it will be seen that the light fixture 11 includes a half-round or semi-cylindrical cover 82 which extends horizontally, the end edges thereof each being in a plane of approximately 45° to the horizontal as indicated at 83 and 84 and also parallel to the edge 40 of the upper tubular segment 15 of the pedestal 10. The half-round cover is closed at the outer end by a plastic end cap 85 and at the inner end by a plastic mounting plate 86. The mounting plate 86 includes a boss 87 at the lower end securing the mounting plate to vertically extending socket bulkhead 88 by means of fastener 89.

The end cap 85 and the mounting plate 86 are interconnected by channels or struts 92 secured to the end cap and mounting plate by fasteners 93. The bulkhead 88 serves as a vertical mounting plate for the socket 94 of U-shape fluorescent bulb 95.

The mounting plate 86 is provided with three spherical wall apertures seen at 97 in FIG. 6 which accomodate balls 98, 99 and 100 on the distal or outer end of the tubular links 65, 66 and 67, respectively. The pressure plate 102, also is provided with spherical wall holes and confines such balls within the spherical wall apertures of the mounting plate 86 and is pressure adjustable through the center fastener 103. Again, the center of the spheres is approximately between the slightly spaced surfaces of the mounting plate and pressure plate.

As indicated, the two tubular links 65 and 66 project slightly beyond the spheres 98 and 99 and are interconnected by transverse link 105 which inlcudes downturned end portions extending diametrically through the ends of the tubular links in the same manner as the transverse link 70 seen in FIG. 5. It will be appreciated that the transverse links 70 and 105 keep the tubular links 65 and 66 from rotating axially with respect to each other and also further insure that they move in parallelism.

Figure 3:
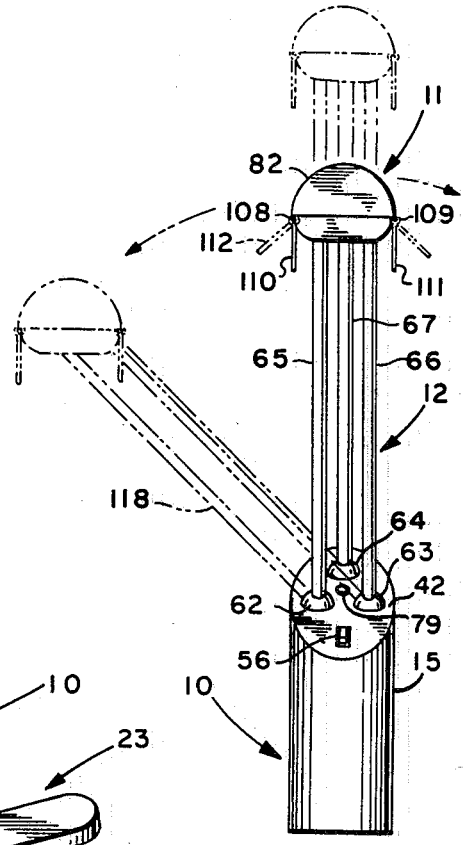
FIG. 3 is a fragmentary elevation of the lamp taken from the line 3—3 of FIG. 2.

As seen perhaps more clearly in FIG. 3, the half-round cover 82 includes beaded edges 108 and 109 on which are mounted angularly adjustable shades 110 and 111, respectively. Such shades may include socket upper edges which simply snap on the beads and which enable the shades to be pivoted about the beads as indicated by the phantom line position seen more clearly at 112 in FIG. 3. The shades and cover may have an interior reflective surface.

It can now be seen that there is provided a lamp which includes a pedestal on a vertical axis with a horizontally extending light fixture 11. The parallelogram linkage supports the fixture for movement through a spherical segment surface of adjustment while maintaining the fixture horizontal. As the fixture moves through the spherical segment, the parallelogram linkage moves within a spherical cone, the axis of which is indicated at 115 in FIG. 2. The apex angle of that cone is 90°. In other words, the linkage may move from a horizontal position seen at 116 to a vertical position seen at 117 or right and left or fore and aft 45° from such axis as seen at 118 in FIG. 3. When moving fore and aft such linkage also always maintains the axis of the fixture parallel to the plane of FIG. 2 or normal to a plane through the axis of the pedestal which plane is in the same plane as FIG. 3. In any event, the axis of the cone extends at an angle approximately 45° to a horizontal plane and the axis of such cone intersects the vertical axis of the pedestal at an angle of approximately 135°.

I claim:

1. A lamp comprising a pedestal, a horizontally extending light fixture, and fixture supporting means extending between said pedestal and fixture operative to move said fixture through a spherical surface of adjustment while maintaining said fixture horizontal and parallel to itself in any other position of adjustment.

2. A lamp as set forth in claim 1 wherein said spherical surface of adjustment is the surface of a spherical segment.

3. A lamp as set forth in claim 2 wherein said fixture supporting means moves within a spherical cone.

4. A lamp as set forth in claim 3 wherein such cone is a right spherical cone.

5. A lamp as set forth in claim 4 wherein the axis of said cone extends at an angle of approximately 45° to a horizontal plane.

6. A lamp as set forth in claim 4 wherein said pedestal includes a vertical axis, and the axis of said cone intersects said vertical axis at an angle of approximately 135°.

7. A lamp as set forth in claim 1 wherein said fixture supporting means comprises a three-link parallelogram linkage.

8. A lamp as set forth in claim 7 wherein the lamp and pedestal include parallel surfaces for such ball and socket connections.

9. A lamp as set forth in claim 8 wherein two of the three links project beyond at least one of such surfaces and are connected to each other at such projecting ends by a transverse link.

10. A lamp as set forth in claim 9 wherein two of the three links project beyond such pedestal surface and are connected to each other at such projecting ends by a transverse link, and spring means in said pedestal connected to said transverse link operative to balance said fixture in all positions.

11. A lamp as set forth in claim 10 including ball and socket joints at each end of each link joining said links to said lamp and pedestal respectively.

12. A lamp as set forth in claim 11 wherein two of the three links project beyond at least one of such surfaces and are linked to each other at such projecting ends.

13. A lamp comprising a pedestal, lamp support means projecting from said pedestal, and a lamp mounted on said lamp support means, said lamp support means comprising a three-link parallelogram linkage operative to move said lamp through a spherical surface of adjustment.

14. A lamp as set forth in claim 13 wherein the lamp and pedestal include parallel surfaces for such ball and socket connections.

15. A lamp as set forth in claim 13 wherein said lamp comprises a horizontal light fixture, said linkage being operative to maintain said fixture horizontal and parallel to itself in all positions of adjustment.

16. A lamp as set forth in claim 15 wherein said spherical surface of adjustment is the surface of a spherical segment.

17. A lamp as set forth in claim 16 wherein said fixture supporting means moves within a spherical cone.

18. A lamp as set forth in claim 17 wherein such cone is a right spherical cone.

19. A lamp as set forth in claim 18 wherein the axis of said cone extends at an angle of approximately 45° to a horizontal plane.

20. A lamp as set forth in claim 13 wherein said lamp includes a half-round cylindrical cover, and shades pivoted to the longitudinal edges of said cover.

21. A lamp as set forth in claim 13 including a table mounted on said pedestal.

22. A lamp as set forth in claim 21 wherein said table is mounted on a swinging arm.

23. A lamp as set forth in claim 22 wherein said table is in the form of a circular tray.

24. A lamp as set forth in claim 23 wherein said tray is mounted for rotation on a vertical axis on the distal end of said swinging arm.

25. A lamp for a recline chair and the like comprising a vertically extending pedestal, a light fixture mounted on top of said pedestal for vertical and horizontal adjustment over the top of such chair, and a table mounted on said pedestal and supported in cantilever fashion therefrom, said table being mounted on a swing arm extending from said pedestal.

26. A lamp as set forth in claim 25 wherein said table is mounted for rotation about a vertical axis on the distal end of said arm.

27. A lamp as set forth in claim 26 wherein said fixture includes a half-round cylindrical cover and pivotal shades mounted on each longitudinal edge of said cover.

28. A lamp for a recline chair or the like comprising a pedestal, a light fixture mounted on top of said pedestal for movement over such chair from a horizontally cantilevered position to a vertical position and for a swinging movement from the top of said pedestal in the same angular extent, and spring means balancing the weight of said fixture in all positions of adjustment.

29. A lamp as set forth in claim 28 wherein said spring means includes a tension spring mounted in said pedestal at an angle to the axis thereof.

* * * * *